US009439523B2

(12) United States Patent
Naesje et al.

(10) Patent No.: US 9,439,523 B2
(45) Date of Patent: Sep. 13, 2016

(54) CLOSURE FOR A CONTAINER, BEVERAGE CONTAINER AND A METHOD OF OPERATING A CLOSURE

(71) Applicant: SmartSeal AS, Stavanger (NO)

(72) Inventors: Kjetil Naesje, Sandnes (NO); Kyrre Fredriksen, Stavanger (NO); Rune Knutsen, Hundvag (NO)

(73) Assignee: SmartSeal AS, Stavanger (NO)

( * ) Notice: Subject to any disclaimer, the term of this patent is extended or adjusted under 35 U.S.C. 154(b) by 0 days.

(21) Appl. No.: 14/382,090

(22) PCT Filed: Mar. 1, 2013

(86) PCT No.: PCT/NO2013/050042

§ 371 (c)(1),
(2) Date: Aug. 29, 2014

(87) PCT Pub. No.: WO2013/129940

PCT Pub. Date: Sep. 6, 2013

(65) Prior Publication Data

US 2015/0028043 A1 Jan. 29, 2015

(30) Foreign Application Priority Data

Mar. 2, 2012 (NO) ..... 20120253
Apr. 19, 2012 (NO) ..... 20120456

(51) Int. Cl.
*B65D 47/04* (2006.01)
*A47G 19/22* (2006.01)
(Continued)

(52) U.S. Cl.
CPC ..... *A47G 19/2272* (2013.01); *B65D 47/0819* (2013.01); *B65D 47/2081* (2013.01); *B65D 47/24* (2013.01); *B65D 51/18* (2013.01); *B65D 2101/0023* (2013.01)

(58) Field of Classification Search
CPC ..... B65D 47/0819; B65D 47/2081; B65D 47/04
USPC ..... 215/315, 311, 307, 253, 250; 220/203.04, 203.07, 203.19, 281, 266, 220/265, 203.27, 203.23; 222/562, 525
See application file for complete search history.

(56) References Cited

U.S. PATENT DOCUMENTS 6,367,668 B1 4/2002 Schwanenberg
2003/0029890 A1 * 2/2003 Olechowski ..... B65D 47/10 222/525

(Continued)

FOREIGN PATENT DOCUMENTS

WO 2004002276 1/2004
WO 2004039690 5/2004

(Continued)

OTHER PUBLICATIONS

International Search Report and Written Opinion for PCT/NO2013/050042, dated Jul. 1, 2013.

*Primary Examiner* — Steven A. Reynolds
*Assistant Examiner* — King M Chu
(74) *Attorney, Agent, or Firm* — Andrus Intellectual Property Law, LLP

(57) ABSTRACT

A closure is for a container, for example a beverage container. In some examples the closure comprises an outer portion connectable to an opening of the container, an axially actuatable inner portion having a sealing member for restricting fluid flow through the closure with the inner portion in a first position and allowing fluid flow through the closure with the inner portion in a second position axially displaced relative to the outer portion, and an annular membrane connecting the outer and inner portions and configured to provide a returning force to resiliently bias the inner portion towards the first position. A beverage container comprises a closure. A method is for operating a closure.

12 Claims, 15 Drawing Sheets

(51) Int. Cl.

| | |
|---|---|
| ***B65D 47/08*** | (2006.01) |
| ***B65D 47/24*** | (2006.01) |
| ***B65D 51/18*** | (2006.01) |
| ***B65D 47/20*** | (2006.01) |

(56) References Cited

U.S. PATENT DOCUMENTS

| | | | | |
|---|---|---|---|---|
| 2005/0173368 | A1* | 8/2005 | Nusbaum | B65D 47/0838 215/237 |
| 2007/0235406 | A1* | 10/2007 | Young | B65D 47/0804 215/253 |
| 2009/0212061 | A1 | 8/2009 | Naesje | |
| 2012/0024913 | A1 | 2/2012 | Suffa et al. | |
| 2013/0026196 | A1 | 1/2013 | Essebaggers et al. | |

FOREIGN PATENT DOCUMENTS

| | | |
|---|---|---|
| WO | 2005026012 | 3/2005 |
| WO | 2006024656 | 3/2006 |
| WO | 2006028378 | 3/2006 |
| WO | 2007059083 | 5/2007 |
| WO | 2007091167 | 8/2007 |
| WO | 2009131457 | 10/2009 |
| WO | 2010134931 | 11/2010 |
| WO | 2012033405 | 3/2012 |

* cited by examiner

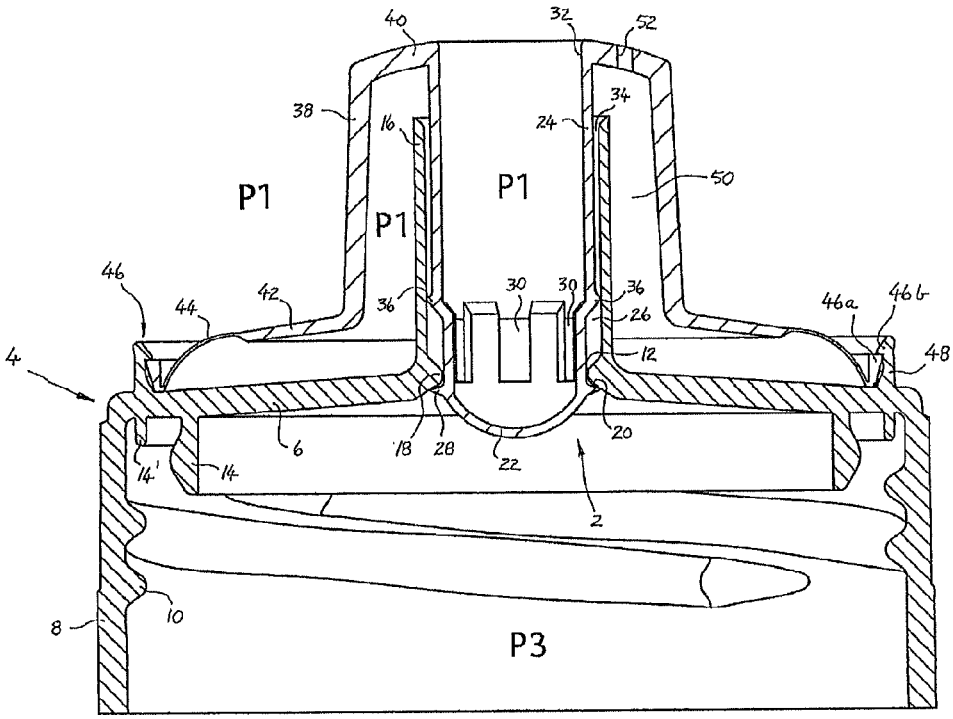
Fig. 22 – Prior art
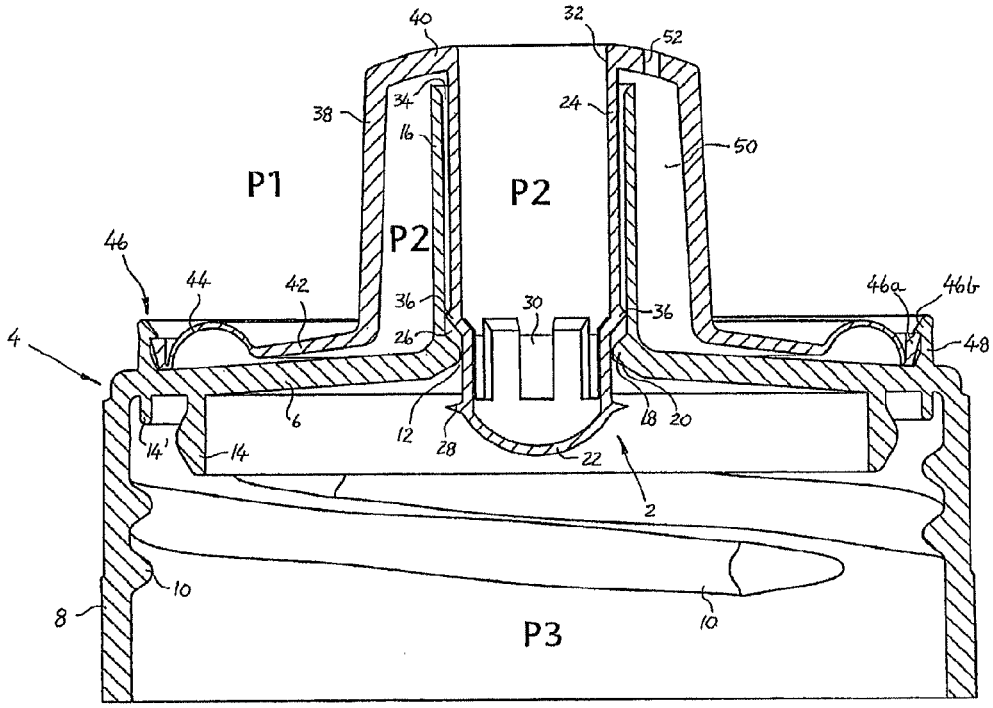
Fig. 23 – Prior art

CLOSURE FOR A CONTAINER, BEVERAGE CONTAINER AND A METHOD OF OPERATING A CLOSURE

CROSS-REFERENCE TO RELATED APPLICATIONS

This application is the U.S. national stage application of International Application PCT/NO2013/050042, filed Mar. 1, 2013, which international application was published on Sep. 6, 2013, as International Publication WO2013/129940 in the English language. The international application is incorporated herein by reference, in entirety. The international application claims priority to Norwegian Patent Application No. 20120253 and Norwegian Patent Application No. 20120456 which are incorporated herein by reference.

FIELD OF THE INVENTION

The invention relates to a closure for a container, for example a beverage container.

BACKGROUND

To allow for improved ease of use, beverage containers may comprise resealable closures that can be operated without the need to unscrew or otherwise remove a cap, thereby allowing for one-handed operation. Conventional resealable closures comprising such features may have a valve that is operable by pulling or pushing on a portion of the closure, thereby allowing liquid contained in the bottle to flow out. The valve may either remain in an open configuration after being opened, allowing for continued flow of liquid as required, or may be configured to return to a closed configuration thereby resealing the container.

Such closures are typically mass manufactured via polymer injection moulding, using multi-cavity moulds configured to form the various components that are required to operate together to form the closures. In certain types of closures, for example where an automatically resealable valve is required, it can be difficult to achieve sufficiently small manufacturing tolerances to give the resulting product a uniform functionality regardless of the specific cavity each part is moulded in.

Various technical aspects are influenced by the way in which a resealable valve is configured. The drinking experience is strongly influenced by the ease of response of the closure valve, i.e. a more easily opened valve tends to result in an improved drinking experience. The valve should therefore be easy to operate, but should ideally not remain open, as this can result in leakage of the contents. However, return of air back into the bottle after drinking is an important concern to avoid deformation of the bottle, since the valve will ideally be air tight once it re-closes. Air returning to the bottle after drinking should therefore be controlled by configuration of the valve. A bottle closure having a configurable resealable valve that aims to address these issues is disclosed in published patent application US 2009/0212061. Configuring the closure such that a lower force tends to return the valve to its closed position allows for control over the timing of this venting function.

A competing requirement, however, is that the membrane should also be resistant to damage by biting or chewing, given that the valve will tend to be operated by mouth action alone. Since users may be children, a particularly important requirement is that any small components in the closure that may represent a choking hazard are not at risk of being separated during normal use. Typical requirements involve a resistance to loosening or breaking when a force of up to 60 N is applied. Furthermore, any detached part should not be so small that it could become lodged in the throat of the user. The British Soft Drinks Association has developed standards based on such requirements.

The aforementioned publication US 2009/0212061 discloses a pressure activated closure device for a beverage container, in which a pressure-sealing membrane is connected between an outer portion of the closure device and a centrally located drinking orifice portion. Movement of the drinking orifice portion results in flexure of the membrane and opening of a valve, allowing the liquid contents of the bottle to flow through the drinking orifice. The elasticity of the membrane ensures that the valve returns to its pressure-sealing position when an under-pressure supplied during drinking ceases. The deformable area of the membrane element must, due to its ring-formed shape, be either very thin or have a long extent in order to provide a sufficiently high flexibility for the membrane to be practically useful. This is an inherent weakness of the type of design in which membrane flexure occurs as a result of an extensive geometrical deformation in an area that by necessity is restricted to a small diametrical extent, i.e. the width of a bottle opening. Furthermore, in one embodiment the membrane is in its periphery only loosely connected to the remaining structure of the closure by means of a snap lock. This connection method provides the membrane with an increased freedom of movement in its outer portion, but this makes it difficult to design a sufficiently strong closure so that the above mentioned regulatory requirement for tensile strength is satisfied. To address this it may be necessary to use several types of plastic materials for the membrane, for example by using a stiffer material for the snap lock zone in relation to the deformation zone. This would result in a technically more complicated solution and as a result lead to the need to use a more expensive manufacturing process.

It is an object of the invention to address one or more of the above mentioned problems.

SUMMARY OF THE INVENTION

In accordance with a first aspect of the invention there is provided a closure for a container, comprising:

- an outer portion connectable to an opening of the container;
- an axially actuatable inner portion having a sealing member for restricting fluid flow through the closure with the inner portion in a first position and allowing fluid flow through the closure with the inner portion in a second position axially displaced relative to the outer portion; and
- an annular membrane connecting the outer and inner portions and configured to provide a returning force to resiliently bias the inner portion towards the first position such that the returning force is lower with the inner portion located at the second position relative to the first position.

Preferably, the annular membrane is configured such that the returning force is a maximum with the inner portion located either between the first and second positions or at the first position.

A closure according to the invention allows for an improvement in the responsiveness to pressure differences across the membrane during a drinking action, while at the same time providing the means to increase the thickness of the membrane element without affecting its deflection properties and/or its sensitivity, and thereby maintaining a high tolerance to mechanical stress during use, such as biting, puncturing or tear-off.

In certain embodiments the annular membrane may comprise a structurally weakened annular region. The weakened annular region may be provided on or adjacent to an upper edge of the outer portion and/or on or adjacent to a lower edge of the inner portion. The structurally weakened annular region may be provided by a reduction in thickness relative to an adjacent portion of the membrane. Alternatively, or additionally, the structurally weakened region may be provided by a portion of membrane material having a relatively increased flexibility, such as by use of a material having a relatively lower stiffness.

The annular membrane may be formed of the same or a different material as that for the inner and outer portions. In the case of a different material, the annular membrane material may have a lower stiffness than the inner and outer portion material.

The weakened annular region may have a radial width of between 0.1 and 10 mm, optionally between 0.1 and 1 mm or between 0.1 and 0.5 mm.

An advantage of the structurally weakened annular region is that adjustments can be made to the geometric elements in a mould tool, for example by changing the height, shape and/or extent of trimming of an individual forming cavity. This makes the design process significantly faster and less costly to set up to an adjusted and optimized production equipment. In addition, more uniform tolerances can be achieved when using multiple cavity moulds.

Furthermore, the membrane can be designed to provide a sufficiently low force when the valve is open to allow time for air to flow back through the closure before the valve reseals, while maintaining a sufficiently high closure force when the valve remains closed.

The closure may further comprise a protective cover removably connected to a body portion comprising the outer portion of the closure. The protective cover may be connected to the body portion by a hinge portion. One or more frangible connections may be provided connecting the protective cover to the body portion. The body portion may comprises a threaded region configured for affixing the closure to a beverage container.

In accordance with the invention, there may be provided a beverage container comprising a closure according to the first aspect of the invention. The container may be a bottle, or alternatively another type of container suitable for holding a liquid, such as a pouch or a laminated pack. The beverage container may contain a liquid beverage, such as a fruit-flavoured drink.

In accordance with a second aspect of the invention there is provided a closure for a container, comprising:

- an outer portion connectable to an opening of the container;
- an axially actuatable inner portion having a sealing member for restricting fluid flow through the closure with the inner portion in a first position and allowing fluid flow through the closure with the inner portion in a second position axially displaced relative to the outer portion; and
- an annular membrane connecting the outer and inner portions and configured to provide a returning force to resiliently bias the inner portion towards the first position, wherein the annular membrane comprises a structurally weakened annular region.

The structurally weakened annular region may be configured such that the returning force provided by the annular membrane is lower with the inner portion in the second position relative to the first position, and is preferably a maximum with the inner portion located either between the first and second positions or at the first position.

In accordance with a third aspect of the invention there is provided a closure for a container, comprising:

- an outer portion connectable to an opening of the container;
- an axially actuatable inner portion having a sealing member for restricting fluid flow through the closure with the inner portion in a first position and allowing fluid flow through the closure with the inner portion in a second position axially displaced relative to the outer portion; and
- an annular membrane connecting an upper edge of the outer portion to a lower edge of the inner portion and configured to provide a returning force to resiliently bias the inner portion towards the first position,
- wherein the closure is configured such that the lower edge of the inner portion displaces past the upper edge of the outer portion when axially displaced from the first position to the second position.

Other optional and preferable features of the second or third aspects of the invention may be correspondent with those of the first aspect.

In accordance with a fourth aspect of the invention there is provided a method of operating a closure for a container comprising:

- providing a beverage container having a closure according to the first or second aspects;
- actuating the inner portion relative to the outer portion to thereby open a valve comprising the sealing member and allow passage of fluid from within the beverage container through an outflow orifice, past the sealing member and out of the closure through a drinking opening.

The inner portion may be maintained displaced relative to the outer portion by a differential suction pressure across the membrane. When the differential suction pressure is removed, the inner portion preferably returns to the first position due to the returning force provided by the membrane to reseal the closure.

DETAILED DESCRIPTION

Aspects and embodiments of the invention are described in further detail below by way of example and with reference to the enclosed drawings in which:

FIGS. 22 and 23 are longitudinal sections through a closure device according to US 2009/0212061 in a closed and open configuration respectively.

Figure 1:
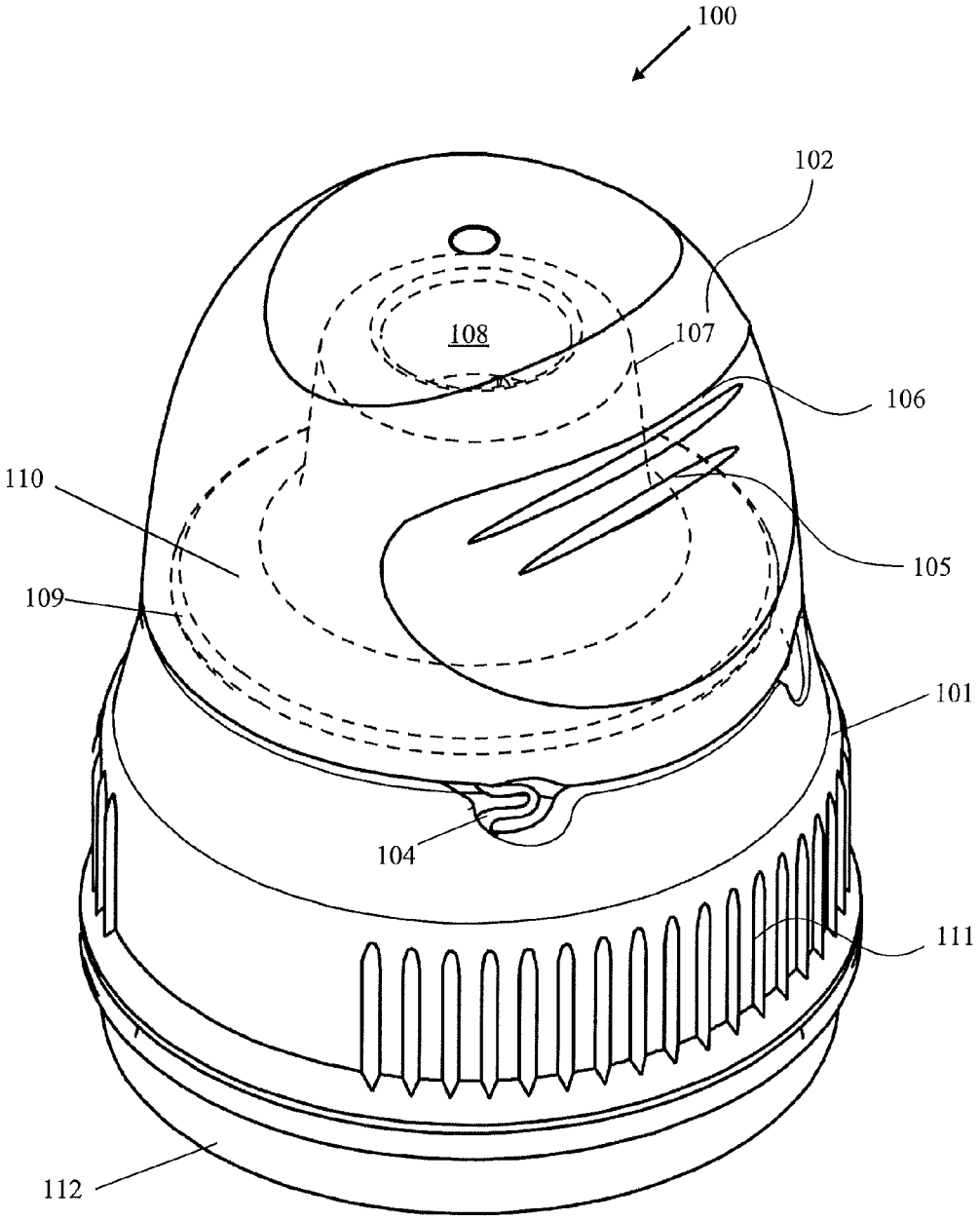
FIG. 1 is an isometric view of a closure according to an aspect of the invention.
Figure 2:
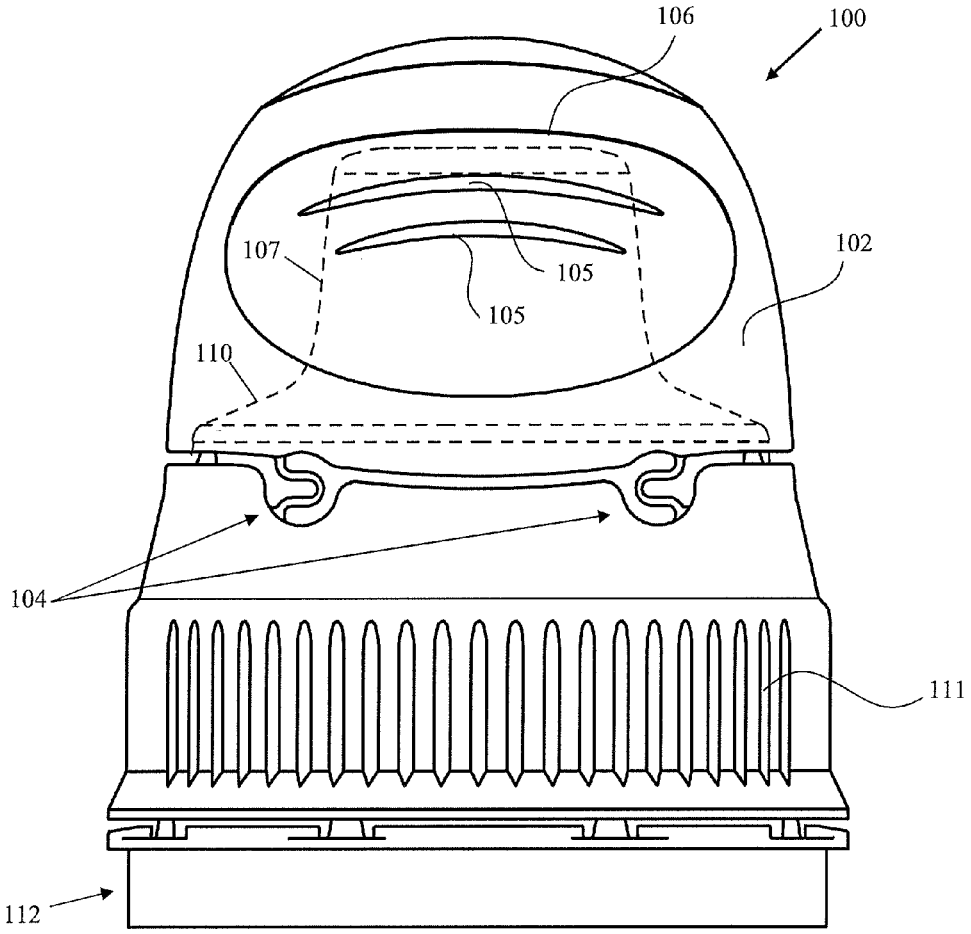
FIG. 2 is a side elevation view of the closure.
Figure 3:
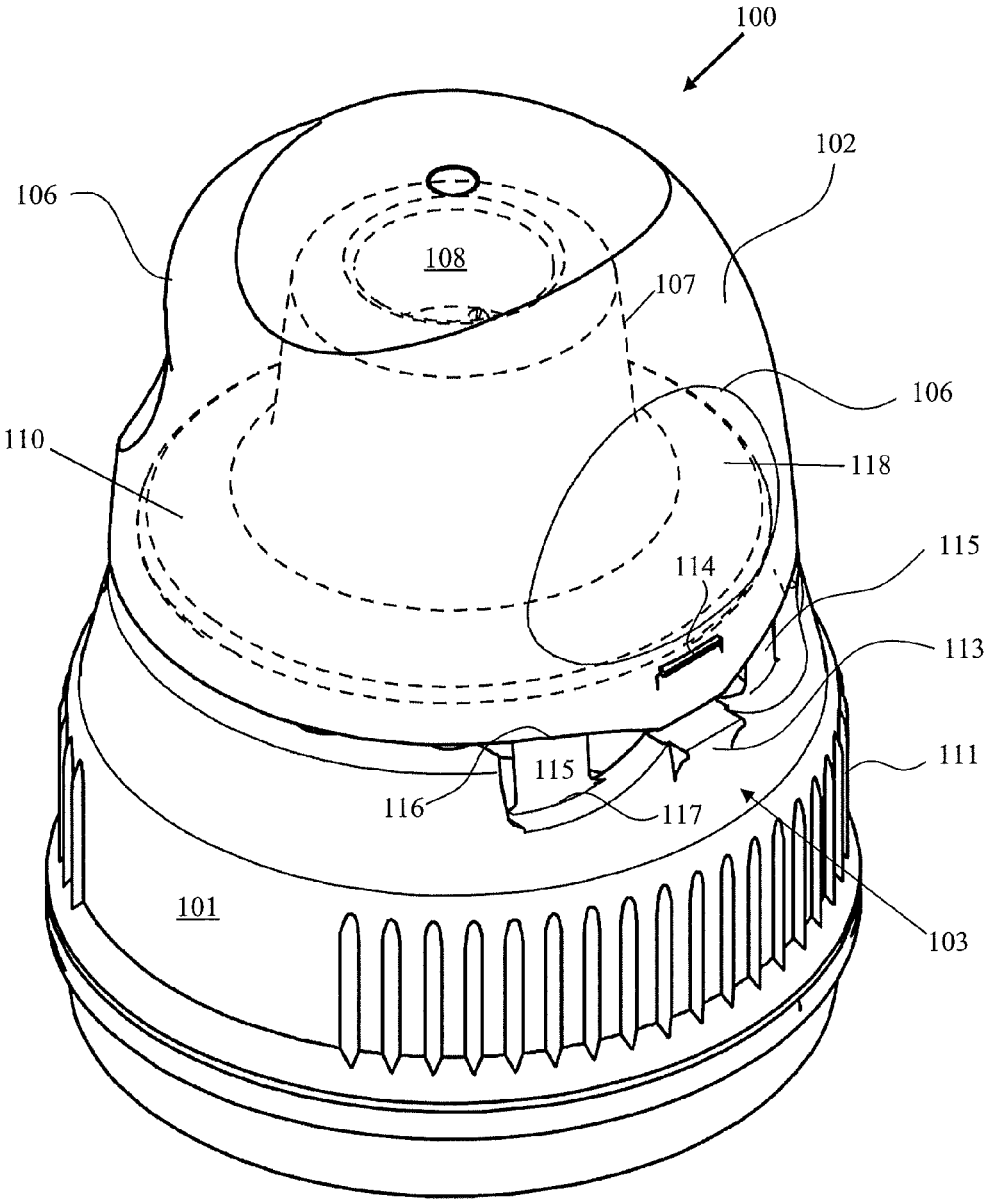
FIG. 3 is an alternative isometric view of the closure.
Figure 4:
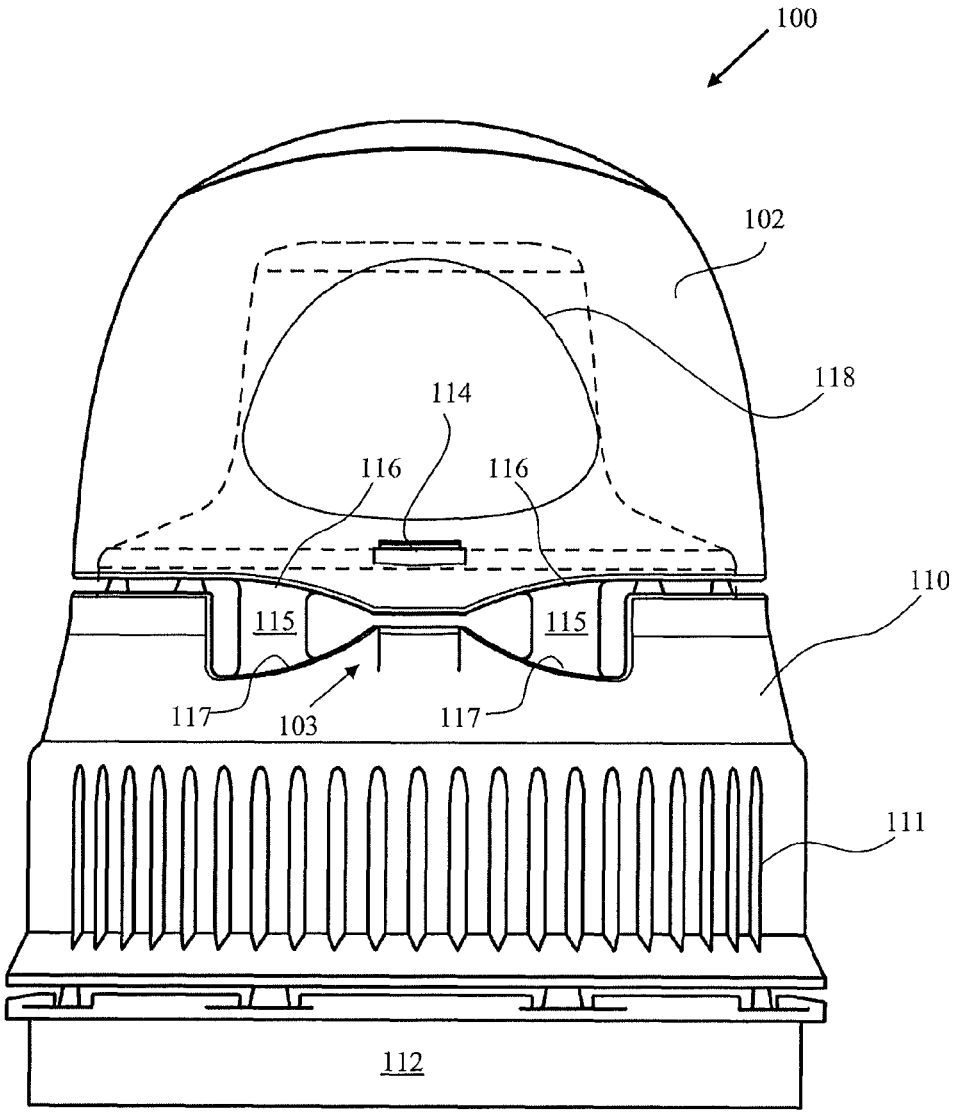
FIG. 4 is an alternative side elevation view of the closure.
Figure 5:
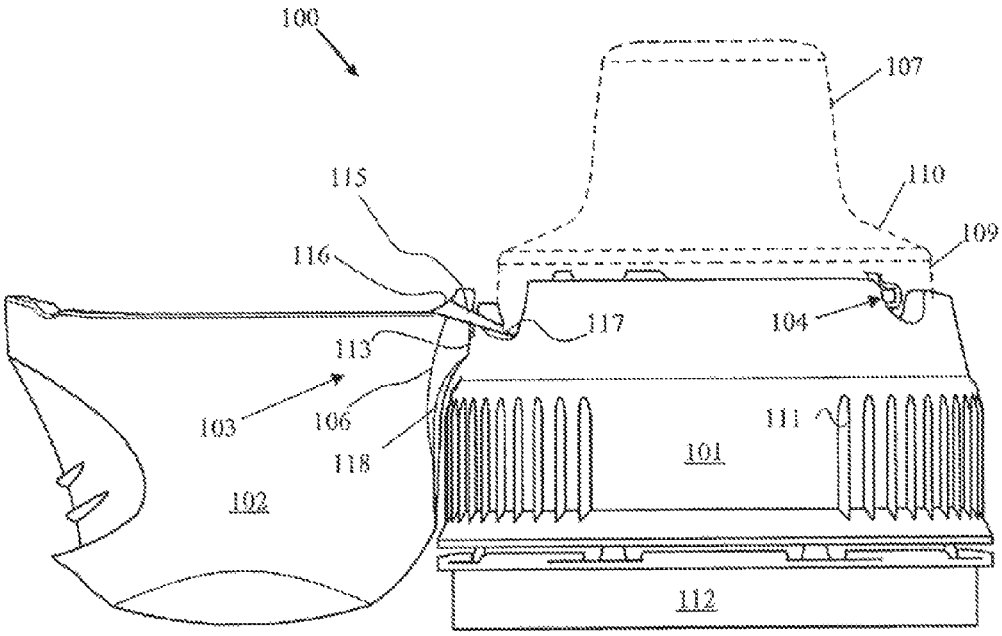
FIG. 5 is a side elevation view of the closure with a protective cover in an opened position.

FIGS. 1 to 4 are external views of an exemplary closure device 100 according to an aspect of the invention, with FIGS. 1 and 3 showing different isometric views of the closure device 100, FIGS. 2 and 4 showing alternative side elevation views of the device 100, and FIG. 5 the closure device 100 with a protective cover 102 fully opened. The closure device 100 comprises a closure body portion 101 and a protective cover 102. The protective cover 102 is connected to the closure body portion 101 by a hinge portion 103 and a pair of cover removal indicators 104. The protective cover 102 may be opened by applying an upwards directed force using a finger placed against a finger grip zone marking 105 and an upper finger grip 106, which breaks the cover removal indicators 104 and exposes an inner portion 107 having a drinking opening 108, the inner portion 107 connected to an outer portion 109 of the closure 100 by a membrane 110.

An outer circumferential surface of the body portion 101 of the closure 100 comprises a series of ribs 111 that serve to enhance grip during capping and removal of the closure from a container such as a bottle. Upon removal of the closure 100 from a container (not shown), a tamper evidence ring 112 will remain on the beverage container.

As illustrated in FIG. 3, the hinge portion 103 comprises protruding portion 113 extending from the outer circumferential edge of the closure body portion 101 and configured to engage with a corresponding depression 114 in the protective cover 102 on opening the cover 102 by flexing the hinge portion 103. On opening, thinned sections 115 of the hinge 103 are stretched and bent about their upper hinge zones 116 and lower hinge zones 117. A recess 118 on the same side of the cover 102 as the hinge portion 113 allows the protective cover 102 to fully open without interference with the body portion 101 with the hinge portion 103 fully deflected, as shown in FIG. 5.

FIG. 5 illustrates the closure 100 as viewed from the side and in a fully opened condition. The cover removal indicators 104 are broken and the cover 102 is rotated nearly 180 degrees about the hinge portion 103 relative to the body portion 101 of the closure 100. In this configuration the protruding portion 113 is engaged with the depression 114 and the thinned sections 115 are stretched and bent on their upper hinge portions 116 and lower hinge portions 117. As described above, the recess 118 on the cover 102 allows for a larger hinge deflection.

Figure 6:
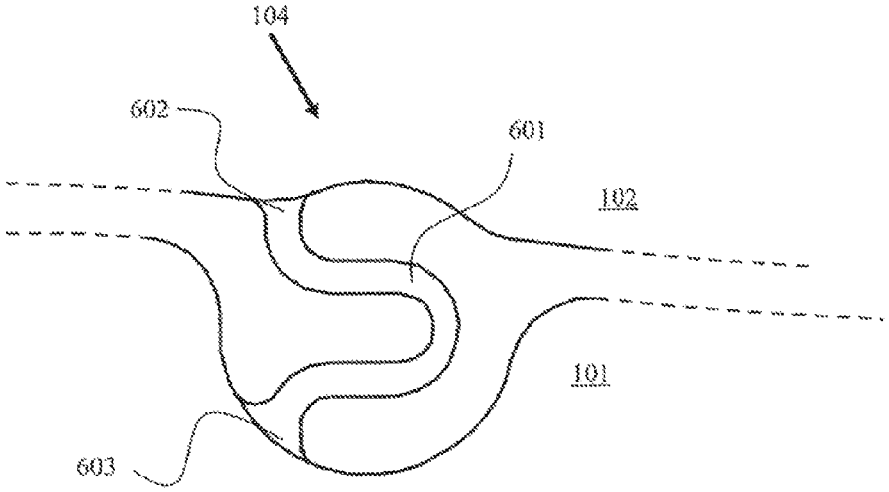
FIG. 6 is a detailed view of a cover removal indicator.

FIG. 6 illustrates in detail the components that form the cover removal indicator mechanism 104 for providing a tamper evidence function on the closure 100. The indicator mechanism 104 consists of a frangible connecting portion 601 in the form of an indicator string connected at a first end 602 to the closure body portion 101 and at a second opposing end 603 to the cover 102. During the initial opening of the cover 102, the indicator string 601 breaks somewhere between its first and second ends 602, 603, so that opening of the cover 102 is unambiguously indicated.

Figure 7:
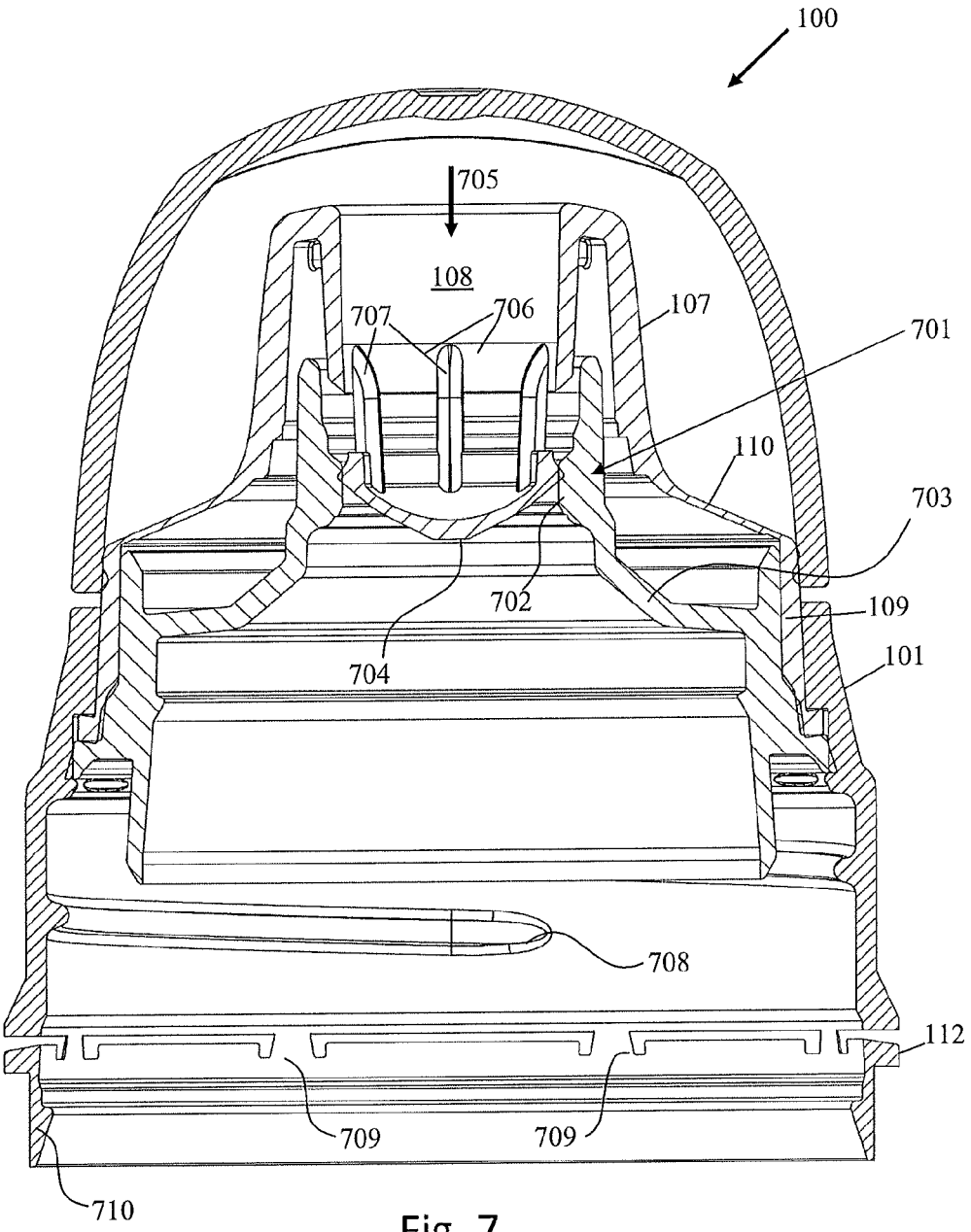
FIG. 7 is a longitudinal section through the closure.

FIG. 7 illustrates a longitudinal section through the closure device 100 described above. A valve 701 is formed by a sealing member 704 sealing against an outflow orifice 702 of an inner wall 703 of the body portion 101 of the closure 100, the sealing member 704 extending through the outlet orifice 702 in the body portion 101. The sealing member 704 is connected to, and forms part of, the inner portion 107 of the closure 100. As indicated in FIG. 7, the inner portion 107 comprises longitudinal ribs 706 connecting to the sealing member 704, with fluid flow paths 707 provided between adjacent ribs 706. Actuation of the inner portion 107 in an axial direction, indicated by arrow 705, causes the membrane 110 connecting the inner portion 107 to the outer portion 109 to flex (as indicated schematically in subsequent figures), causing the sealing member 704 to disengage from the inner wall 703 and thereby allow fluid to flow through the closure 100 through the outlet orifice 702 and drinking opening 108. Elasticity of the membrane 110 provides a biasing force that, on releasing of an actuation force in the inner portion 107, tends to return the inner portion 107 to the closed position indicated in FIG. 7, resealing the sealing member 704 against the inner wall 703 and closing the outlet orifice 702.

FIG. 7 also illustrates part of a threaded region 708 for affixing the closure 100 to a beverage container. The tamper evidence ring 112 is provided with several weakened zones 709 that are configured to break when an inner ridge 710 acts to retain the ring 112 on the beverage container by engaging with a complementary slot in the container (not shown). Upon unscrewing the closure 100 from the container, the weakened sections 709 will break and the indicator ring 112 will remain on the beverage container.

Figure 8:
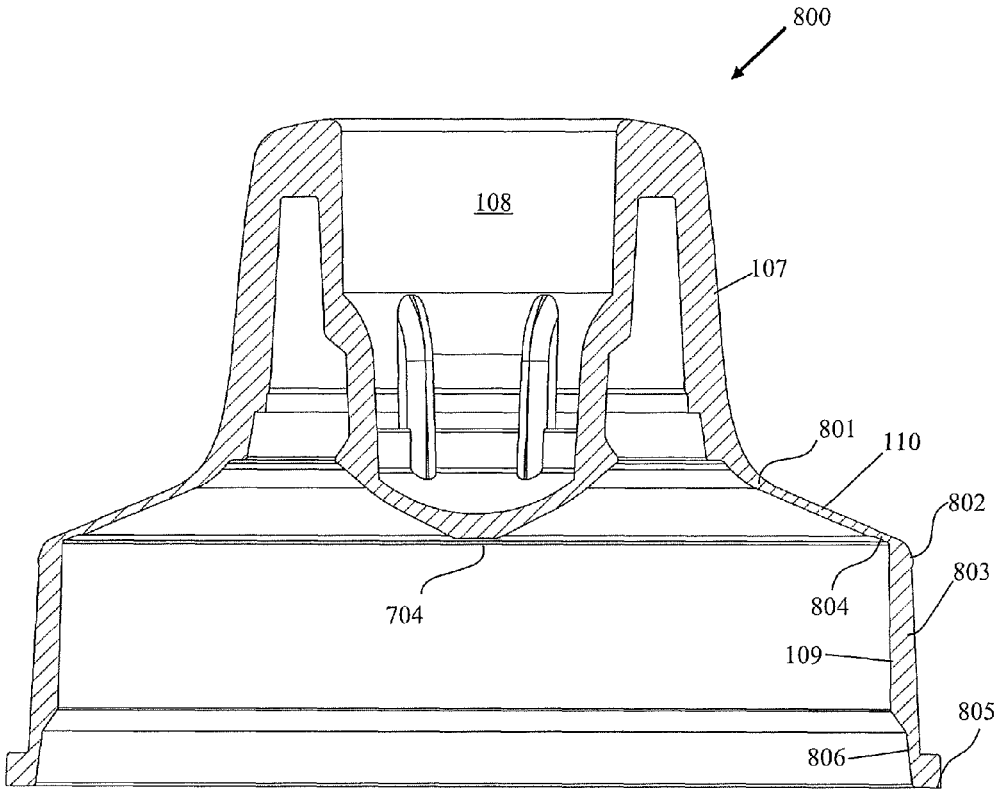
FIG. 8 is a longitudinal section through a portion of the closure comprising a membrane.

FIG. 8 illustrates a longitudinal section of an actuatable portion 800 of the closure 100 as described above, the actuatable portion 800 comprising the inner portion 107 with sealing member 704, the outer portion 109 and the connecting membrane 110. The drinking opening 108 extends through the centre of the inner portion 107. The membrane 110 extends radially between a lower edge 801 of the inner portion 107 and an upper edge 802 of the outer portion 109, the outer portion 109 forming a circumferential wall 803 of the body portion 101 of the closure 100.

In the embodiment illustrated in FIG. 8, the membrane 110 comprises a weakened annular region 804 adjacent the upper edge 802 of the outer portion 109, the weakened annular region 804 being provided by a reduction in thickness of the membrane 110 relative to the immediately adjacent wall 803 and the adjacent portion of the membrane 110.

In the embodiment illustrated in FIG. 8, the wall 803 forming the outer portion 109 comprises a fastening foot 805 at a lower end 806 of the outer portion 109, the foot 805 serving to permanently connect the wall to the rest of the body portion 101 of the closure 100.

Figure 9:
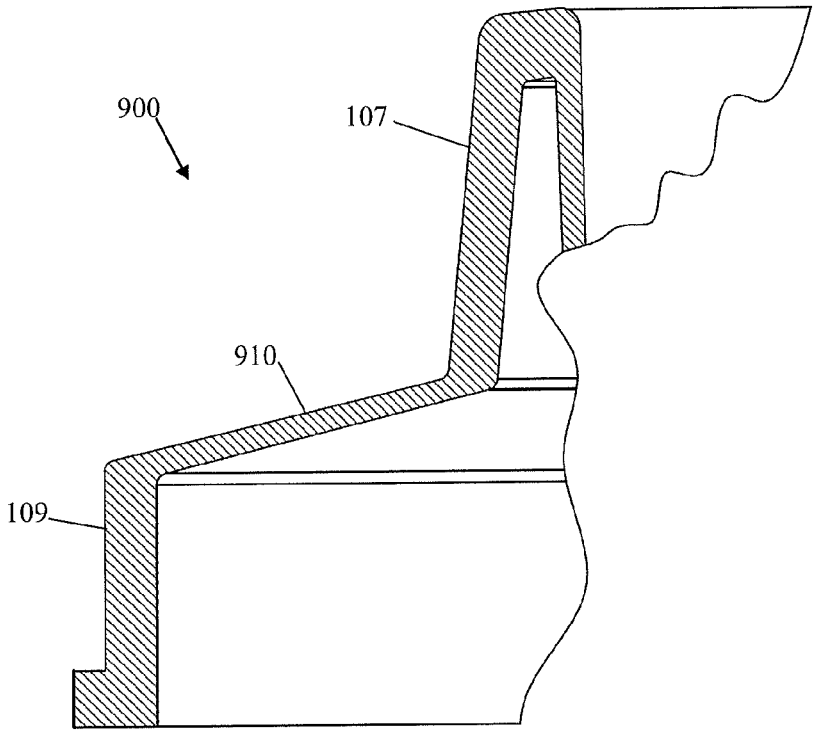
FIGS. 9 and 10 are simplified sectional views across a membrane portion of an exemplary closure in closed and open positions respectively.
Figure 10:
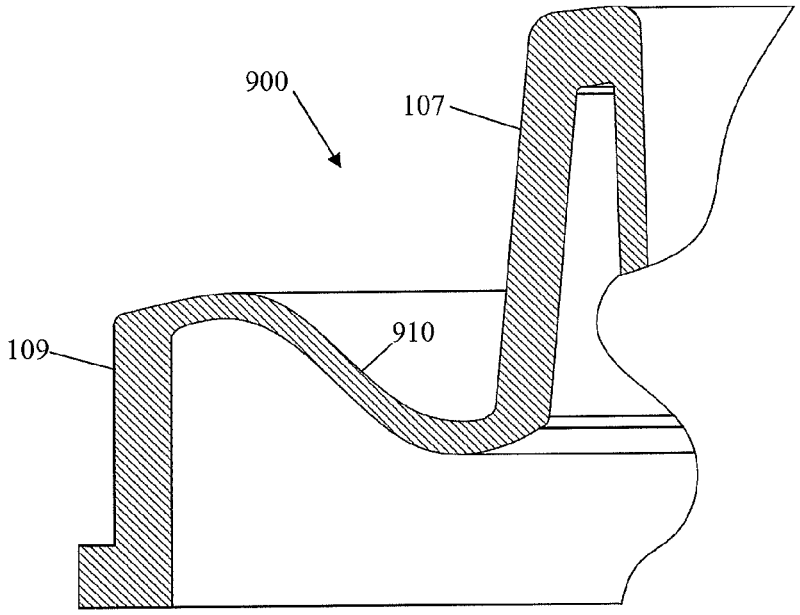

FIG. 9 illustrates a partial sectional view of an actuatable portion 900 having a membrane 910 without a weakened wall section, in which the membrane 910 comprises a substantially uniform thickness between the outer portion 109 and the inner portion 107. On actuation of the inner portion 107 relative to the outer portion 109, the membrane 110 flexes into the configuration indicated in FIG. 10.

Because the membrane 910 is not provided with a thinned or weakened annular region, flexure of the membrane is substantially stiffened, and the resulting flexed form is in a characteristic S-shape. This results firstly in a substantially increased actuation force required to displace the inner portion 107, resulting in a poorer drinking experience.

Figure 11:
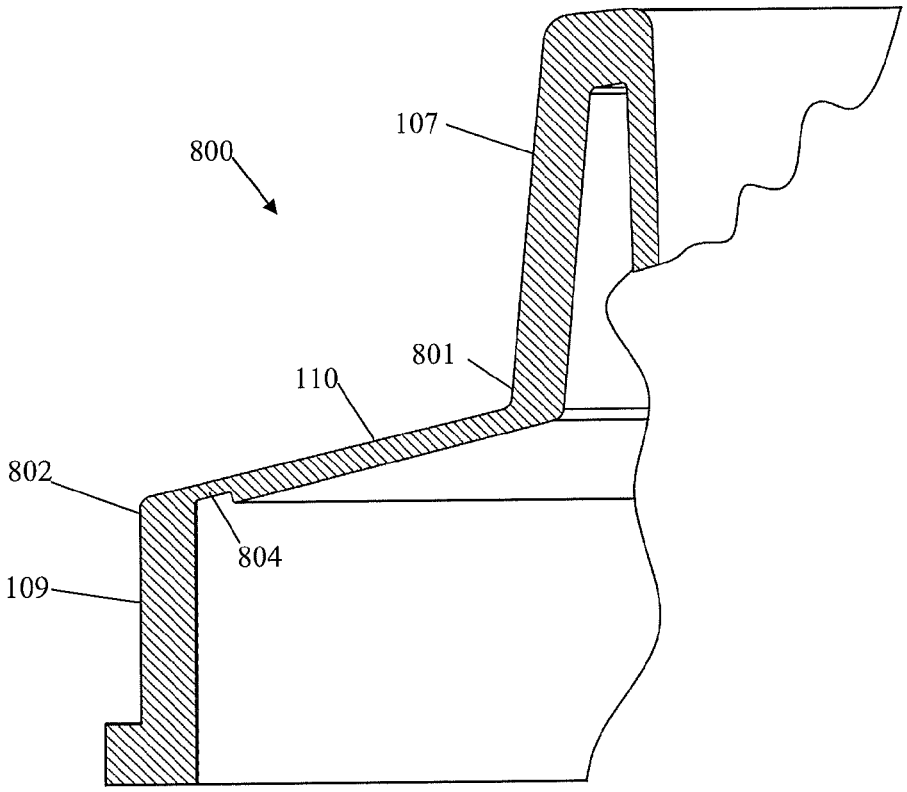
FIGS. 11 and 12 are simplified sectional views across a membrane portion of an alternative exemplary closure in closed and open positions respectively
Figure 12:
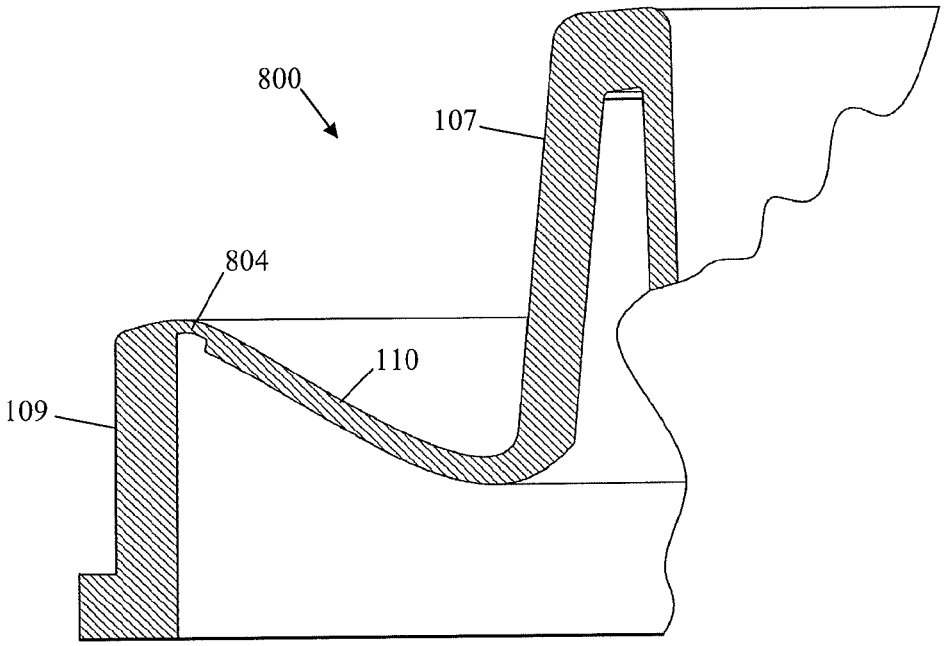

FIG. 11 illustrates a partial sectional view of an actuatable portion 800 of a closure 100 in a form similar to that shown in FIG. 8, in which the membrane 110 is provided with annular structurally weakened zone 804 in region of the membrane adjacent to the upper edge 802 of the outer portion 109. FIG. 12 illustrates the actuatable portion 800 with the inner portion 107 axially displaced relative to the outer portion 109, resulting in flexing of the connecting membrane 110. In comparison with the membrane 910 of FIGS. 9 and 10, the membrane 110 is substantially more flexible as a result of the structurally weakened zone 804, resulting in a different flexed form. The actuating force required for maintaining the inner portion 107 in the actuated position is thereby reduced due to the reduced stiffness of the membrane 110, without substantially compromising the integrity of the closure.

A differential suction pressure during drinking that applies across the membrane 110 in the actuated position shown in FIG. 12 would, without the structurally weakened zone 804, need to be higher to maintain the membrane in the flexed configuration in order to keep the valve open. Using the structurally weakened zone, however, the suction pressure required to maintain the valve open is reduced, while still retaining a high closing force with the actuatable portion 800 in the closed position (FIG. 11).

Figure 13:
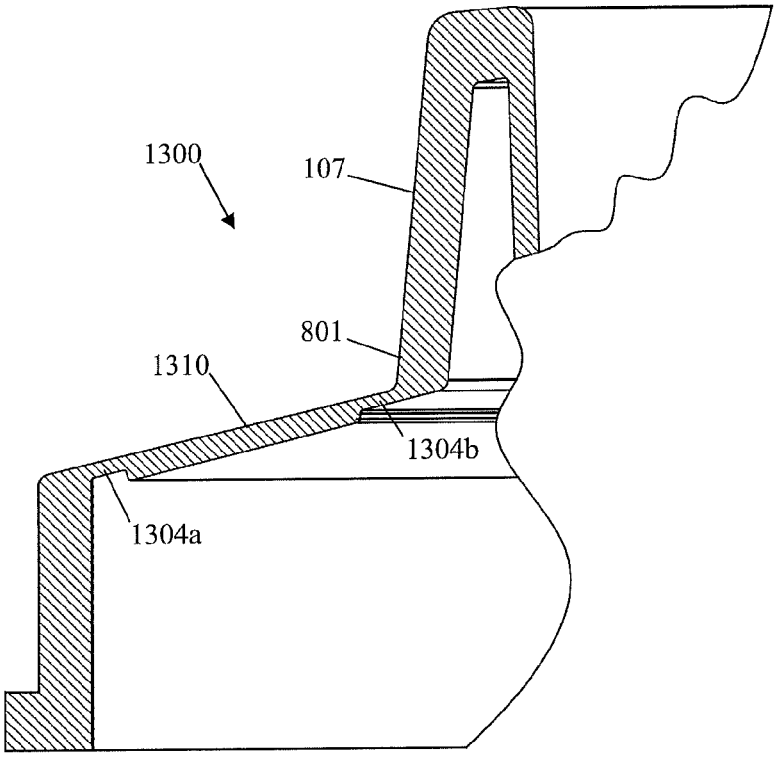
FIGS. 13 and 14 are simplified sectional views across a membrane portion of an alternative exemplary closure in closed and open positions respectively.
Figure 14:
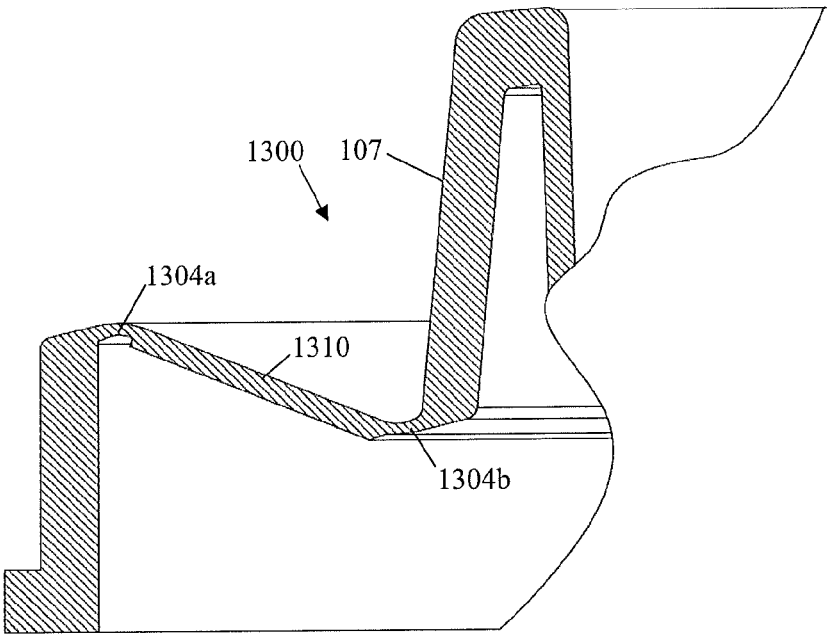

FIG. 13 illustrates a partial sectional view of an alternative embodiment of an actuatable portion 1300 of a closure 100, in which the membrane element 1310 is provided with a second structurally weakened annular region 1304*b* in addition to a first structurally weakened annular region 1304*a*, the first weakened annular region 1304*a* being similar to that described above in relation to FIGS. 11 and 12. In this embodiment the second weakened annular region 1304*b* is provided on the membrane 1310 adjacent the lower edge 801 of the inner portion 107, and is in the form of a reduction in thickness relative to an adjacent portion of the membrane 1310. A force applied to the inner portion 107 to actuate the valve will apply a higher bending stress at both weakened annular regions 1304*a*, 1304*b*, causing the membrane to flex in a different way, illustrated in FIG. 14 with the inner portion 107 in the actuated position. As can be seen in this figure, deformation of the membrane is now largely confined to the weakened regions 1304*a*, 1304*b*. A differential suction pressure required to maintain the valve open is thereby further reduced while maintaining a returning force on the inner portion 107 in the closed position.

Figure 15:
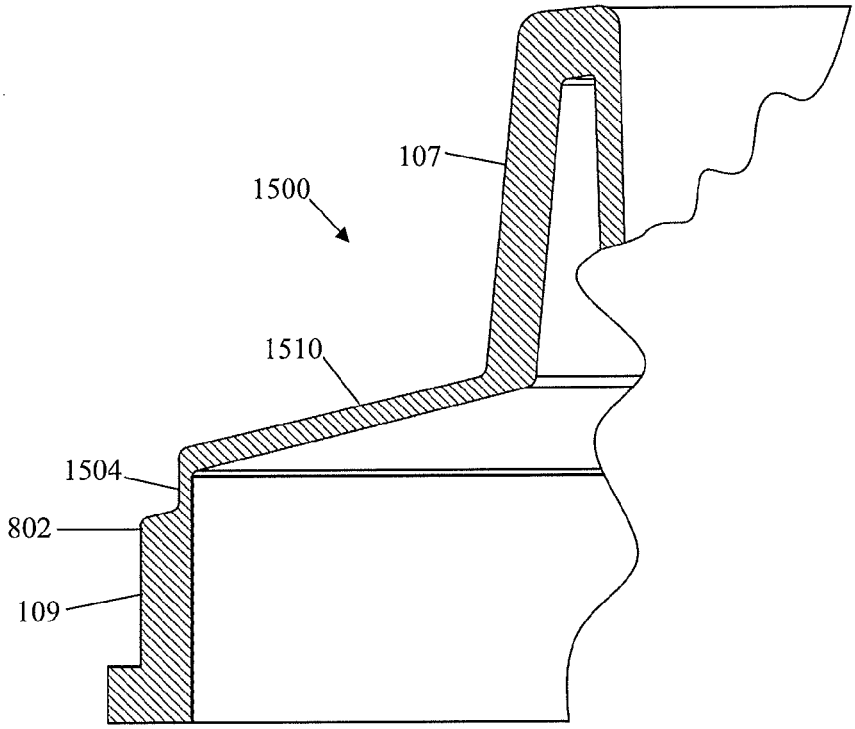
FIGS. 15 and 16 are simplified sectional views across a membrane portion of an alternative exemplary closure in closed and open positions respectively.
Figure 16:
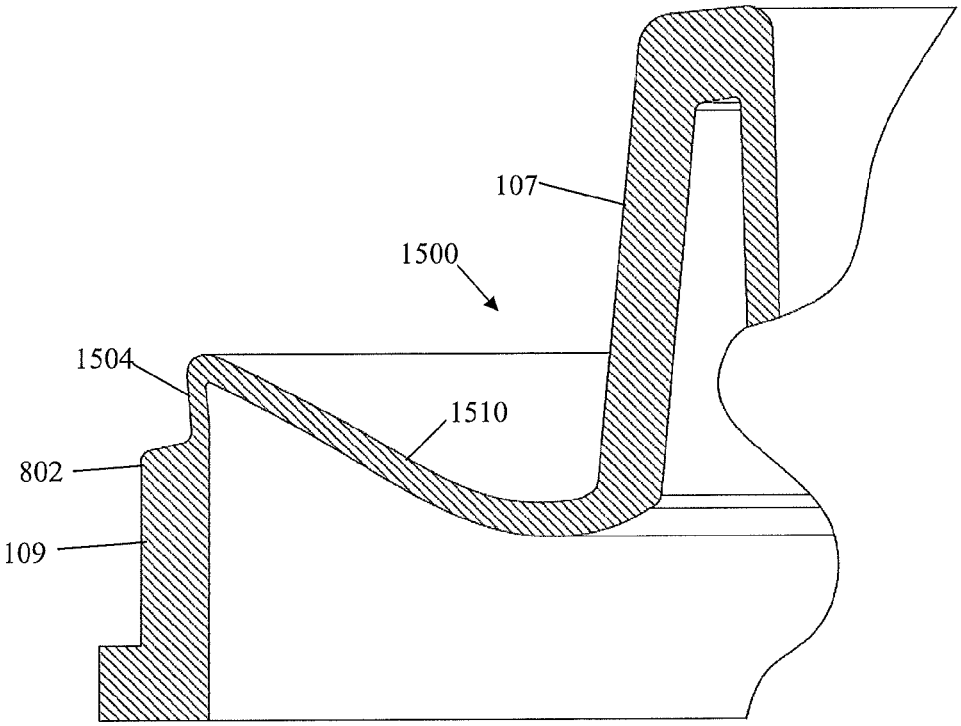

FIG. 15 illustrates a partial sectional view of a further alternative embodiment of an actuatable portion 1500 of a closure 100, in which a structurally weakened annular region 1504 is provided on the upper edge 802 of the outer portion 109. The effect of this, as can be seen in FIG. 16 illustrating the actuatable portion 1500 with the inner portion 107 in the opened position, is similar to that of providing the weakened annular region in the membrane adjacent the upper edge 802 of the outer portion. In this embodiment, the deformation in the membrane is now concentrated in the outer edge, which can allow the valve opening to be increased due to less deformation of the membrane 1510.

Figure 17:
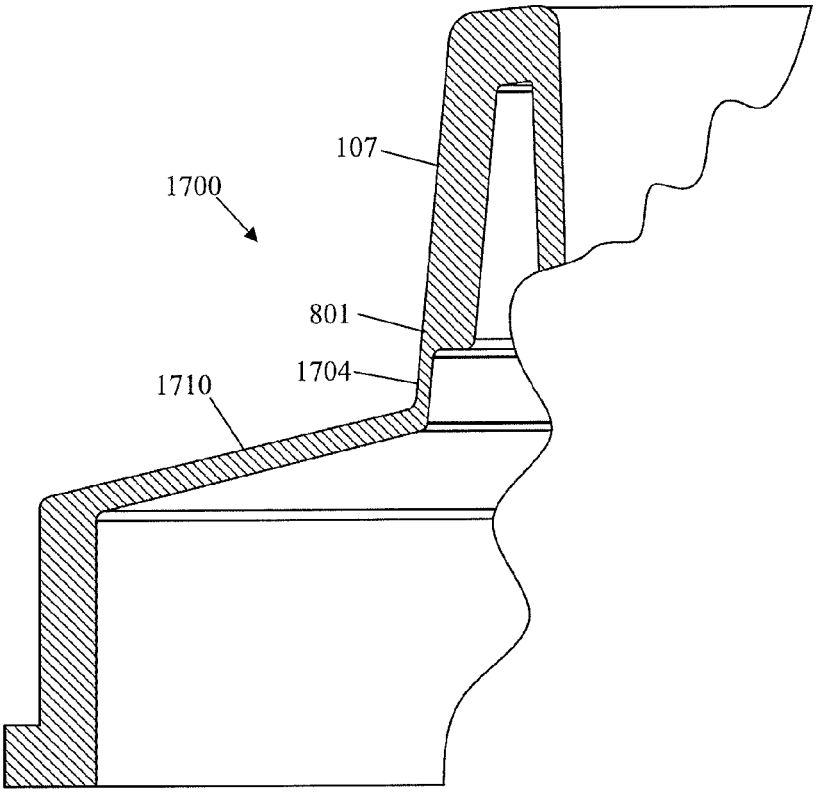
FIGS. 17 and 18 are simplified sectional views across a membrane portion of an alternative exemplary closure in closed and open positions respectively.
Figure 18:
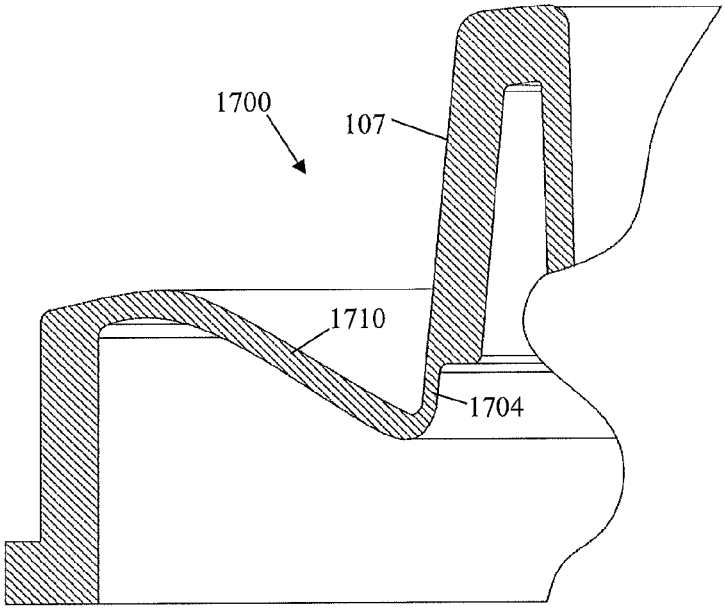

FIG. 17 illustrates a partial sectional view of a further alternative embodiment of an actuatable portion 1700 of a closure 100, in which a structurally weakened annular region 1704 is provided on the lower edge 801 of the inner portion 107 adjacent to the membrane 1710. The effect of this, as can be seen in FIG. 18 illustrating the actuatable portion 1700 with the inner portion 107 in the opened position, is to provide a reduction in the applied force required to actuate the valve between that of the unmodified version (FIGS. 9 and 10) and the version with a structurally weakened annular region along the outer edge of the membrane (FIGS. 11 and 12).

Figure 19:
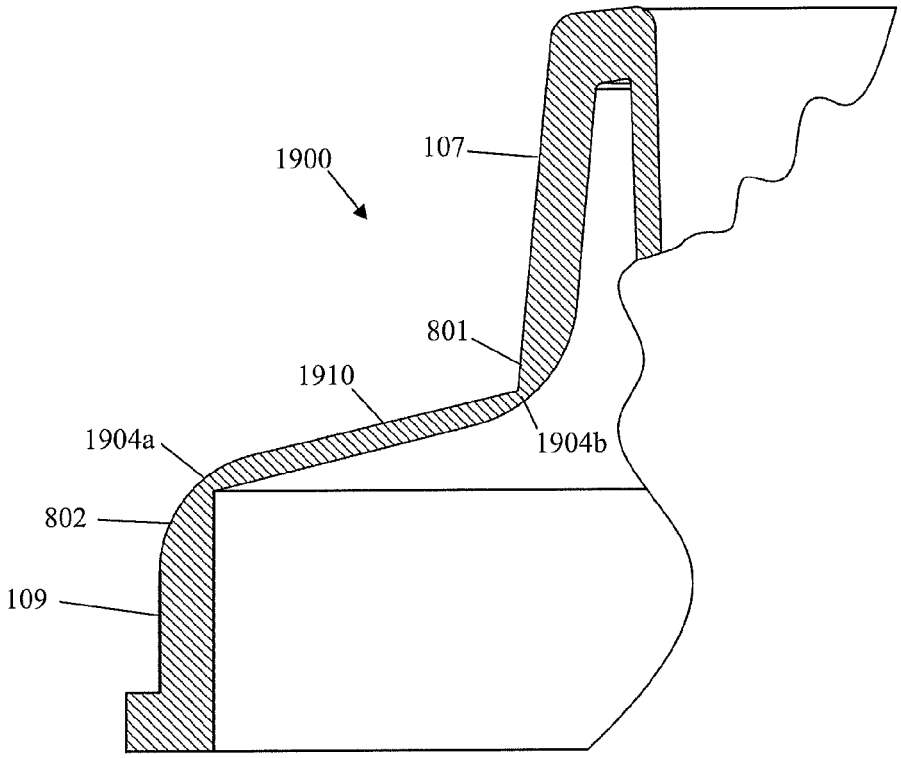
FIGS. 19 and 20 are simplified sectional views across a membrane portion of an alternative exemplary closure in closed and open positions respectively.
Figure 20:
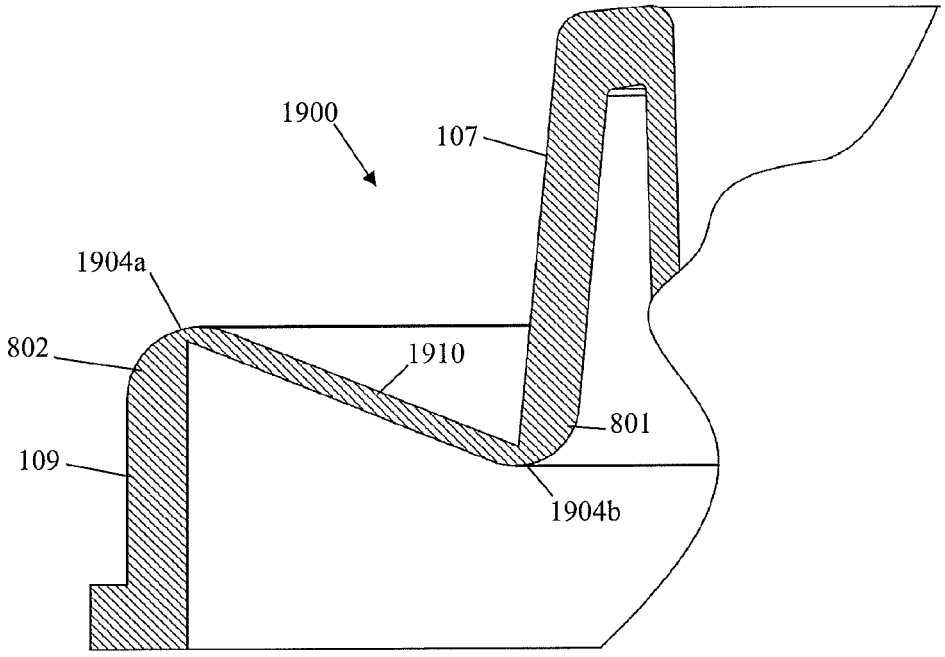

FIG. 19 illustrates a partial sectional view of a further alternative embodiment of an actuatable portion 1900 of a closure 100, in which a structurally weakened annular regions 1904*a*, 1904*b* are provided on both the lower edge 801 of the inner portion 107 and the upper edge 802 of the outer portion 109, in this case the weakened annular regions 1904*a*, 1904*b* being defined by a difference in internal and external radii at the edges where the membrane 1910 joins the inner and outer portions 107, 109, in each case the internal radius being smaller than the external radius. If this difference is sufficiently large then the resulting structurally weakened zones can provide a significant contribution to the reduction in force required to maintain the valve open and an increase in the possible valve displacement. FIG. 20 illustrates the actuatable portion 1900 of FIG. 19 with the inner portion 107 in the axially displaced position, with the membrane 1910 fully flexed. The shape of the flexed membrane in this embodiment is similar to that of the embodiment described above in relation to FIGS. 13 and 14. Deformation in the membrane 1910 is concentrated at the peripheral edges in the structurally weakened regions 1904*a*, 1904*b* and the valve displacement is increased due to less deformation of the membrane being required.

Figure 21:
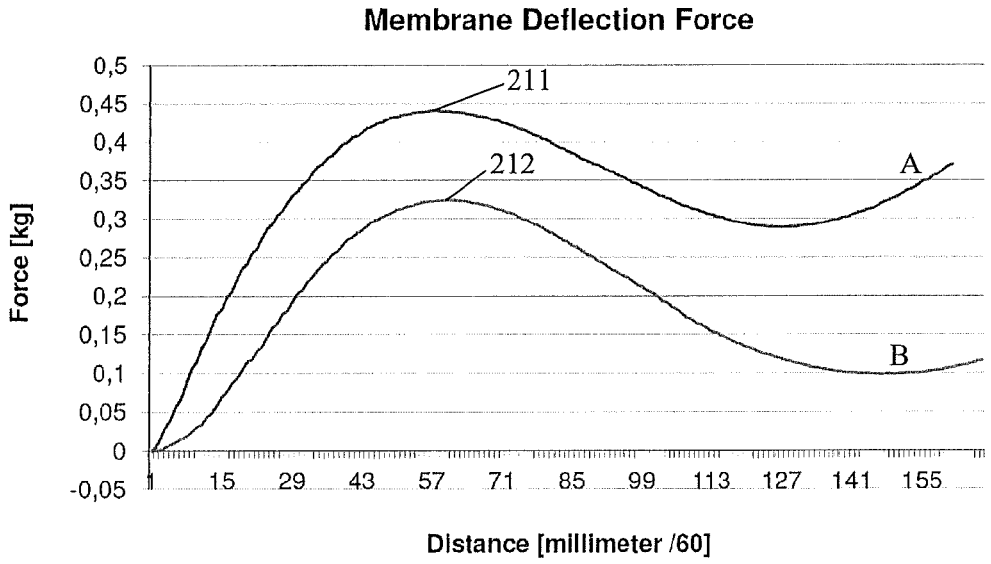
FIG. 21 is a graphical representation of membrane deflection force as a function of actuation distance for closures having two different exemplary membranes.

FIG. 21 illustrates in graphical form a series of measurements of the deflection forces necessary to mechanically actuate (i.e. open) two exemplary closure embodiments, having a membrane without (curve A) and with (curve B) an annular structurally weakened region according to an aspect of the invention. Curve B represents the force required to actuate the valve as a function of displacement for an actuatable portion of the form illustrated in FIGS. 11 and 12, whereas curve A represents the force required for an actuatable portion of the form illustrated in FIGS. 9 and 10. As can be seen, the force necessary to move the valve differs dramatically, even when only one structurally weakened annular region is incorporated. In each case, the force required to actuate the valve, which largely corresponds to the returning force provided by the membrane, reaches a maximum 211, 212 between a first closed position at a lower (but non-zero) displacement and a second open position at a maximum displacement. The maximum displacement may be limited by an end stop, such as when the inner portion 107 contacts the inner wall 703 of the body portion 101 (FIG. 7), resulting in the returning force provided by the membrane being a maximum with the inner portion 107 located between the first (closed) and second (open) positions. The closure may be configured such that the maximum returning force is applied when the valve is in the closed position, so as to maximise the sealing force. An advantage of the form of force-displacement profile illustrated in FIG. 21 is that the force required to retain the valve in the open position can be reduced compared to that required to open the valve. Given the viscoelastic nature of the polymeric materials that may be used for the actuatable portion of the closure, the reduction in returning force at maximum displacement allows time for air to return through the closure prior to the inner portion returning to the closed position after a differential suction pressure across the membrane is removed. By appropriate design of the membrane, a sufficiently low return force can be designed to allow enough time for air to return while maintaining a sufficiently high return force with the valve in the closed position, thereby keeping the closed valve sealed. The closure may even be configured such that the valve is stable in both the open and closed positions, although this is less preferable due to the possibility of leakage as the valve remains open after drinking.

FIG. 22 illustrates a longitudinal section through a closure constructed according to previously published patent application US 2009/0212061. In this closure, a thinned and flexible area 44 is connected by a relatively rigid membrane 42 which, at its middle section, is connected to an inner portion 38 having a drinking opening 32. The thinned region 44 is connected to an annular flange portion designed with a snap fitting connecting it to the rest of the construction.

FIG. 23 illustrates a longitudinal section through the closure of FIG. 22, but in an opened configuration. The thinned and flexible area 44 is now deformed and has changed its shape. The rest of the membrane 42 has, however, due to its rigidity, not been deformed. As described above, when large deformations need to take place across a small annular area, this leads to a high resistance to deformation. The forces required to move the membrane is in this case are non-linear and tend to increase exponentially as the axial movement of the inner portion 38 increases. This results in difficult requirements for the material making up the closure. To achieve sufficient movement in the deformation zone 44, the material must be relatively soft, but at the same time should be stiff enough to transfer forces from the remaining membrane 42 without severe deformations. One solution is to let the difference between the material thickness of the rigid membrane 42 and the flexible area 44 be as large as possible. In that case, however, the ability to uniformly mould the closure will be affected and the product is more likely to fail in mass production.

A further difference of the closure according to the invention compared with that disclosed in US 2009/0212061 is that the lower edge 801 of the inner portion 107 of the closure (see, for example, FIGS. 11 and 12) displaces past the upper edge 802 of the outer portion 109 when actuating the inner portion from the first (closed) position to the second (open) position. This feature is associated with the different flexed shape of the membrane connecting the inner and outer portions, which allows for a lower returning force with the inner portion in the displaced second position.

Other embodiments are intentionally within the scope of the invention, which is defined by the appended claims.

The invention claimed is:

1. An under pressure activatable closure for a container, comprising:

an operating member connectable to an opening of the container;

the operating member comprising in the form of a continuous, unitary structure a tubular outer portion provided with an upper edge, a tubular inner portion provided with a lower edge, an annular membrane connecting the upper edge of the outer portion and the lower edge of the inner portion, a discharge tube coaxially located within the tubular inner portion, the discharge tube forming a drinking opening, the discharge tube comprising longitudinal ribs and lateral fluid flow paths between adjacent ribs, and a sealing member at a free end of the discharge tube;

a partition connectable to the opening of the container and positioned between the opening of the container and the operating member;

the partition comprising in the form of a continuous, unitary structure an inner wall, an outflow orifice aligned with the discharge tube and a tube shaped sleeve facing away from the container and positioned between the tubular inner portion and the discharge tube;

the annular membrane, the tubular inner portion, the discharge tube and the sealing member are axially actuatable relative to the outer portion between a first position and a second position where the second position is closer to the container, and where the sealing member in the first position is engaging the outflow orifice and where the sealing member in the second position is disengaged from the outflow orifice to allow fluid to flow from the container through the outflow orifice via the fluid flow paths and the drinking opening;

the lower edge is in the second position displaced to a position closer to the container than the upper edge; and the annular membrane is configured to provide a returning force to resiliently bias the inner portion, the discharge tube and the sealing member towards the first position such that the returning force is lower with the inner portion located at the second position relative to the first position.

2. The closure of claim 1 wherein the annular membrane is configured such that the returning force is a maximum with the inner portion located between the first and second positions.

3. The closure of claim 1 wherein the annular membrane comprises a structurally weakened annular region.

4. The closure of claim 3 wherein the weakened annular region is provided on or adjacent to the upper edge of the outer portion.

5. The closure of claim 3 wherein the weakened region is provided on or adjacent to the lower edge of the inner portion.

6. The closure of claim 3 wherein the structurally weakened annular region is provided by a reduction in thickness relative to an adjacent portion of the membrane.

7. The closure of claim 3 wherein the structurally weakened annular region is provided by a material having a lower stiffness relative to that of the membrane, the inner portion or the outer portion.

8. The closure of claim 1 comprising a protective cover removably connected to a body portion comprising the outer portion of the closure.

9. The closure of claim 8 wherein the protective cover is connected to the body portion by at least one of a hinge portion and one or more frangible connections connecting the protective cover to the body portion.

10. The closure of claim 1 wherein the body portion comprises a threaded region configured for affixing the closure to a beverage container.

11. A beverage container for containing a beverage, the beverage container comprising a closure, wherein the closure comprises:

an operating member connectable to an opening of the container;

the operating member comprising in the form of a continuous, unitary structure a tubular outer portion provided with an upper edge, a tubular inner portion provided with a lower edge, an annular membrane connecting the upper edge of the outer portion and the lower edge of the inner portion, a discharge tube coaxially located within the tubular inner portion, the discharge tube forming a drinking opening, the discharge tube comprising longitudinal ribs and lateral fluid flow paths between adjacent ribs, and a sealing member at a free end of the discharge tube;

a partition connectable to the opening of the container and positioned between the opening of the container and the operating member;

the partition comprising in the form of a continuous, unitary structure an inner wall, an outflow orifice aligned with the discharge tube and a tube shaped sleeve facing away from the container and positioned between the tubular inner portion and the discharge tube;

the annular membrane, the tubular inner portion, the discharge tube and the sealing member are axially actuatable relative to the outer portion between a first position and a second position where the second position is closer to the container, and where the sealing member in the first position is engaging the outflow orifice and where the sealing member in the second position is disengaged from the outflow orifice to allow fluid to flow from the container through the outflow orifice via the fluid flow paths and the drinking opening;

the lower edge is in the second position displaced to a position closer to the container than the upper edge; and the annular membrane is configured to provide a returning force to resiliently bias the inner portion, the discharge tube and the sealing member towards the first position such that the returning force is lower with the inner portion located at the second position relative to the first position.

12. The beverage container of claim 11 wherein the container is a bottle.

* * * * *